US008610702B2

(12) United States Patent
Kim et al.

(10) Patent No.: US 8,610,702 B2
(45) Date of Patent: Dec. 17, 2013

(54) GAMMA VOLTAGE CONTROLLER, GRADATION VOLTAGE GENERATOR AND DISPLAY DEVICE HAVING THE SAME

(75) Inventors: In-Suk Kim, Gyeonggi-do (KR); Jae-Hyuck Woo, Gyeonggi-do (KR); Jae-Goo Lee, Gyeonggi-do (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 1199 days.

(21) Appl. No.: 12/496,942

(22) Filed: Jul. 2, 2009

(65) Prior Publication Data

US 2010/0001984 A1 Jan. 7, 2010

(30) Foreign Application Priority Data

Jul. 7, 2008 (KR) ..... 10-2008-0065584

(51) Int. Cl.
*G09G 5/00* (2006.01)
*G09G 3/36* (2006.01)

(52) U.S. Cl.
USPC ..... 345/212; 345/89

(58) Field of Classification Search
USPC ..... 345/76–100, 204, 690; 399/49
See application file for complete search history.

(56) References Cited

U.S. PATENT DOCUMENTS

| | | | | |
|---|---|---|---|---|
| 5,754,150 | A * | 5/1998 | Matsui | 345/89 |
| 6,480,178 | B1 * | 11/2002 | Itakura et al. | 345/89 |
| 7,760,178 | B2 * | 7/2010 | Takada et al. | 345/89 |
| 2002/0186230 | A1 * | 12/2002 | Kudo et al. | 345/690 |
| 2005/0168416 | A1 * | 8/2005 | Hashimoto et al. | 345/76 |
| 2008/0285990 | A1 * | 11/2008 | Nishizawa | 399/49 |
| 2009/0096731 | A1 * | 4/2009 | Woo et al. | 345/87 |

FOREIGN PATENT DOCUMENTS

| | | |
|---|---|---|
| JP | 2001-004976 | 1/2001 |
| JP | 2006-292817 | 10/2006 |
| KR | 1020030063149 | 7/2003 |
| KR | 1020030075915 | 9/2003 |

* cited by examiner

*Primary Examiner* — Chanh Nguyen
*Assistant Examiner* — James Nokham
(74) *Attorney, Agent, or Firm* — F. Chau & Associates, LLC

(57) ABSTRACT

A gamma voltage controller includes a gamma distribution unit that generates a plurality of voltages by performing voltage divisions between a first gradation voltage and a N(th) gradation voltage, a gamma selection unit having first through M(th) gamma selectors that respectively select first through M(th) gamma voltages among the plurality of voltages, a gamma buffer unit that changes inflection points of the gamma curve, and buffers the first through M(th) gamma voltages to output buffered first through M(th) gamma voltages, and a gradation distribution unit that generates second through N−1(th) gradation voltages by performing voltage divisions among the buffered first through M(th) gamma voltages. Each of the buffers includes a feedback loop, and some of the buffers change inflection points of the gamma curve.

6 Claims, 10 Drawing Sheets

GAMMA VOLTAGE CONTROLLER, GRADATION VOLTAGE GENERATOR AND DISPLAY DEVICE HAVING THE SAME

CROSS-REFERENCE TO RELATED APPLICATIONS

This application claims priority, under 35 U.S.C. §119, of Korean Patent Application No. 2008-0065584, filed on Jul. 7, 2008 in the Korean Intellectual Property Office (KIPO), the contents of which are herein incorporated by reference in their entirety.

BACKGROUND

1. Field of the Invention

The present invention relates liquid crystal display devices, and more particularly to a gamma voltage controller capable of outputting a wide range of voltages for various LCD display panels, a gradation voltage generator having the gamma voltage controller, and a display device having the gradation voltage generator.

2. Description of the Related Art

Liquid crystal displays (LCD) adjust differences among data voltages according to the particular gamma characteristics of various LCD panels. The adjustment of differences among data voltages may be performed by a gradation voltage generator in the LCD. The gradation voltage generator in conventional LCDs cannot finely adjust differences among data voltages, so that the conventional LCD cannot satisfy various gamma characteristics of LCD panels.

SUMMARY OF THE INVENTION

An aspect of the invention provides a gamma voltage controller capable of outputting a wide-range of voltages for use in various display panels by enabling a manufacturer or use to define a gamma curve and to finely adjusting inflection points of the gamma curve.

Another aspect of the invention provides a gradation voltage generator having the gamma voltage controller.

Another aspect of the invention provides a display device having the gradation voltage generator.

In some exemplary embodiments, a gamma voltage controller may include a gamma distribution unit that generates a plurality of voltages by performing voltage divisions between a first gradation voltage and a N(th) gradation voltage, a gamma selection unit having first through M(th) gamma selectors that respectively select first through M(th) gamma voltages among the plurality of voltages to define a gamma curve, a gamma buffer unit that adjusts inflection points of the gamma curve, and that buffers the first through M(th) gamma voltages to output buffered first through M(th) gamma voltages, and a gradation distribution unit that generates second through N−1 (th) gradation voltages by performing voltage divisions among the buffered first through M(th) gamma voltages. Here, N may be a positive integer greater than 2, and M may be a positive integer smaller than N.

In some embodiments, the gamma buffer unit may include first through n(th) gamma non-adjustment buffers that buffer n gamma voltages outputted from the first through M(th) gamma selectors to output n buffered gamma voltages to the gradation distribution unit, and first through m(th) inflection point adjustment buffers that buffer m gamma voltages outputted from the first through M(th) gamma selectors to output m buffered gamma voltages to the gradation distribution unit. Contact points where the first through m(th)th inflection point adjustment buffers are coupled to the gradation distribution unit may be adjusted to adjust inflection points of the gamma curve. Here, n and m are positive integers and $n+m=M$.

In some embodiments, each of the first through m(th) inflection point adjustment buffers may include a first amplifier that amplifies a difference between a gamma voltage outputted from the gamma selection unit and a output voltage fed back from a selected on of the second amplifiers, the second amplifiers being respectively coupled to different points on the gradation distribution unit and that amplify the difference outputted from the first amplifier, and an inflection point adjustment switch unit that couples the first amplifier to one of the second amplifiers.

In some embodiments, each of the first through n(th) gamma non-adjustment buffers may include a first amplifier that amplifies a difference between a gamma voltage outputted from the gamma selection unit and a output voltage fed back from second amplifier, and the second amplifier that amplifies the difference outputted from the first amplifier.

In some embodiments, the gamma voltage controller may further include a gamma selection register that provides the first through M(th) gamma selectors with first through M(th) gamma selection signals for controlling the first through M(th) gamma selectors.

In some embodiments, the gamma voltage controller may further include a inflection point adjustment register (INFPAR) that provides the first through m(th) inflection point adjustment buffers with first through m(th) inflection point adjustment signals for controlling the first through m(th) inflection point adjustment buffers.

In some embodiments, a $$\frac{(M+1)}{2}(th)$$

gamma voltage outputted from a $$\frac{(M+1)}{2}(th)$$

gamma selector to the gradation distribution unit through the gamma buffer unit may be used as an X-axis symmetry reference voltage.

In some exemplary embodiments, a gradation voltage generator may include a reference voltage selection unit that selects a maximum reference voltage and a minimum reference voltage among a plurality of power voltages generated by performing voltage divisions between a first power voltage and a second power voltage, a gradation voltage selection unit that selects the maximum reference voltage as a first gradation voltage and the minimum reference voltage as a N(th) gradation voltage, or that selects the minimum reference voltage as the first gradation voltage and the maximum reference voltage as the N(th) gradation voltage, and a gamma voltage controller that selects first through M(th) gamma voltages among a plurality of voltages generated by performing voltage divisions between the first gradation voltage and the N(th) gradation voltages to define a gamma curve, that adjusts inflection points of the gamma curve by buffering the first through M(th) gamma voltages, and that generates second through N−1(th) gradation voltages by performing voltage divisions among the buffered first through M(th) gamma voltages. Here, N may be a positive integer greater than 2, and M may be a positive integer smaller than N.

In some embodiments, the gamma voltage controller may include a gamma distribution unit that generates the plurality of voltages by performing voltage divisions between the first gradation voltage and the N(th) gradation voltage, a gamma selection unit having first through M(th) gamma selectors that respectively select the first through M(th) gamma voltages among the plurality of voltages to define the gamma curve, a gamma buffer unit that adjusts inflection points of the gamma curve and that buffers the first through M(th) gamma voltages to output the buffered first through M(th) gamma voltages, and a gradation distribution unit that generates the second through N−1(th) gradation voltages by performing voltage divisions among the buffered first through M(th) gamma voltages.

In some embodiments, the gamma buffer unit may include first through n(th) gamma non-adjustment buffers that buffer n gamma voltages outputted from the first through M(th) gamma selectors to output n buffered gamma voltages to the gradation distribution unit, first through m(th) inflection point adjustment buffers that buffer m gamma voltages outputted from the first through M(th) gamma selectors to output m buffered gamma voltages to the gradation distribution unit. Contact points where the first through m(th) inflection point adjustment buffers are coupled to the gradation distribution unit may be adjusted to adjust inflection points of the gamma curve. Here, n is a positive integer smaller than M, and m is a positive integer equal to M−n.

In some embodiments, each of the first through m(th) inflection point adjustment buffers may include a first amplifier that amplifies a difference between a gamma voltage outputted from the gamma selection unit and a output voltage fed back from second amplifiers, the second amplifiers that are respectively coupled to different points on the gradation distribution unit and that amplify the difference outputted from the first amplifier, and an inflection point adjustment switch unit that couples the first amplifier to one of the second amplifiers.

In some embodiments, each of the first through n(th) gamma non-adjustment buffers may include a first amplifier that amplifies a difference between a gamma voltage outputted from the gamma selection unit and a output voltage fed back from the selected second amplifier, and the second amplifier that amplifies the difference outputted from the first amplifier.

In some embodiments, the reference voltage selection unit may include a power voltage distributor that generates the plurality of voltages by performing voltage divisions between the first power voltage and the second power voltage, a maximum reference voltage selector that selects the maximum reference voltage among the first power voltage through a half power voltage in response to a maximum selection signal, a minimum reference voltage selector that selects the minimum reference voltage among the second power voltage through the half power voltage in response to a minimum selection signal, a maximum control register that provides the maximum reference voltage selector with the maximum selection signal, and a minimum control register that provides the minimum reference voltage selector with the minimum selection signal.

In some embodiments, the gradation voltage selection unit may include a first gradation voltage selector that selects the maximum reference voltage or the minimum reference voltage as the first gradation voltage based on an inversion control signal, a second gradation voltage selector that selects the minimum reference voltage or the maximum reference voltage as the N(th) gradation voltage based on the inversion control signal, and a X-axis symmetry register that outputs the inversion control signal to the first gradation voltage selector and the second gradation voltage selector.

In some embodiments, the first gradation voltage selector may output the maximum reference voltage as the first gradation voltage and the second gradation voltage selector may output the minimum reference voltage as the second gradation voltage when a logic level of the inversion control signal is a first level, and the first gradation voltage selector may output the minimum reference voltage as the first gradation voltage and the second gradation voltage selector may output the maximum reference voltage as the second gradation voltage when the logic level of the inversion control signal is a second level.

In some embodiments, the gradation voltage selection unit may include a first gradation buffer that buffers the first gradation voltage outputted from the first gradation voltage selector, and a second gradation buffer that buffers the N(th) gradation voltage outputted from the second gradation voltage selector.

In some exemplary embodiments, a display device may include a display panel, a gate driver that provides gate-on voltages to gate lines of the display panel, a data driver that provides data voltages to data lines of the display panel, a controller that controls the gate driver and the data driver, and a gradation voltage generator that generates second through N−1 (th) gradation voltages based on first and N(th) gradation voltages and that provides the first through N(th) gradation voltages to the data driver. The gradation voltage generator may include a reference voltage selection unit that selects a maximum reference voltage and a minimum reference voltage among a plurality of power voltages generated by performing voltage divisions between a first power voltage and a second power voltage, a gradation voltage selection unit that selects the maximum reference voltage as the first gradation voltage and the minimum reference voltage as the N(th) gradation voltage, or that selects the minimum reference voltage as the first gradation voltage and the maximum reference voltage as the N(th) gradation voltage, and a gamma voltage controller that selects first through M(th) gamma voltages among a plurality of voltages generated by performing voltage divisions between the first gradation voltage and the N(th) gradation voltages to define a gamma curve, that adjusts inflection points of the gamma curve by buffering the first through M(th) gamma voltages, and that generates the second through N−1 (th) gradation voltages by performing voltage divisions among the buffered first through M(th) gamma voltages. Here, N may be a positive integer greater than 2, and M may be a positive integer smaller than N.

In some embodiments, the gamma voltage controller may include a gamma distribution unit that generates the plurality of voltages by performing voltage divisions between the first gradation voltage and the N(th) gradation voltage, a gamma selection unit having first through M(th) gamma selectors that respectively select the first through M(th) gamma voltages among the plurality of voltages to define the gamma curve, a gamma buffer unit that adjusts inflection points of the gamma curve and that buffers the first through M(th) gamma voltages to output the buffered first through M(th) gamma voltages, and a gradation distribution unit that generates the second through N−1 (th) gradation voltages by performing voltage divisions among the buffered first through M(th) gamma voltages.

In some embodiments, the gamma buffer unit may include first through n(th) gamma non-adjustment buffers that buffer n gamma voltages outputted from the first through M(th) gamma selectors to output n buffered gamma voltages to the gradation distribution unit, first through m(th) inflection point adjustment buffers that buffer m gamma voltages outputted from the first through M(th) gamma selectors to output m buffered gamma voltages to the gradation distribution unit. Contact points where the first through m(th) inflection point adjustment buffers are coupled to the gradation distribution unit may be adjusted to adjust inflection points of the gamma curve. Here, n is a positive integer smaller than M, and m is a positive integer equal to M−n.

In some embodiments, each of the first through m(th) inflection point adjustment buffers may include a first amplifier that amplifies a difference between a gamma voltage outputted from the gamma selection unit and a output voltage fed back from the selected one of the second amplifiers, the second amplifiers being respectively coupled to different points on the gradation distribution unit and that amplify the difference outputted form the first amplifier, and an inflection point adjustment switch unit that couples the first amplifier to one of the second amplifiers. Each of the first through n(th) gamma non-adjustment buffers may include a first amplifier that amplifies a difference between a gamma voltage outputted from the gamma selection unit and a output voltage fed back from the second amplifier, and the second amplifier that amplifies the difference outputted from the first amplifier.

Accordingly, the gamma voltage controller, the gradation voltage generator and the display device according to exemplary embodiments may define a gamma curve and may adjust inflection points of the gamma curve to output wide-range voltages for various display panels having unique gamma characteristics.

Various exemplary embodiments will be described more fully with reference to the accompanying drawings, in which embodiments are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout this application.

It will be understood that, although the terms first, second, etc. may be used herein to describe various elements, these elements should not be limited by these terms. These terms are used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments and is not intended to be limiting of the invention. As used herein, the singular forms "a," "an" and "the" are intended to include the plural forms as well, unless the context clearly indicates otherwise.

BRIEF DESCRIPTION OF THE DRAWINGS

Exemplary embodiments of the invention will be more clearly understood from the following detailed description taken in conjunction with the accompanying drawings in which.

DETAILED DESCRIPTION OF EXEMPLARY EMBODIMENTS OF THE INVENTION

Figure 1:
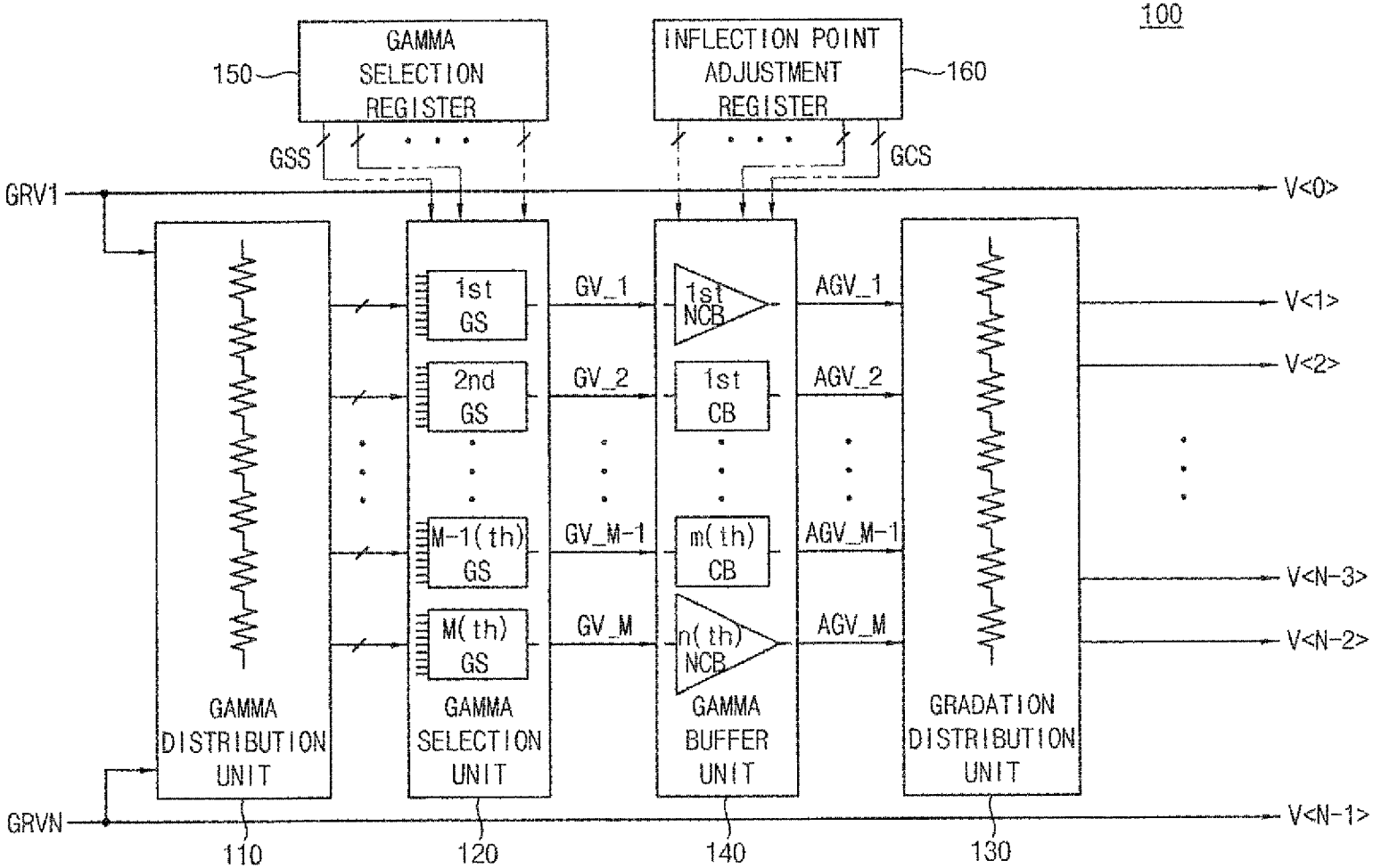
FIG. 1 is a block diagram of a gamma voltage controller according to an exemplary embodiment of the invention.

FIG. 1 is a block diagram of a gamma voltage controller according to an exemplary embodiment.

Referring to FIG. 1, the gamma voltage controller 100 includes a gamma distribution unit 110, a gamma selection unit 120, a gradation distribution unit 130, and a gamma buffer unit 140. The gamma voltage controller 100 further includes a gamma selection register 150 and a inflection point adjustment register (INFPAR) 160.

The gamma distribution unit 110 includes a resistor string (e.g., a plurality of series-connected resistors, each resistor having the same resistance R). The gamma distribution unit 110 generates a plurality of voltages by performing voltage divisions between a first gradation voltage GRV1 (i.e., V<0>) and an N(th) gradation voltage GRVN (i.e., V<N−1>). Here, N is a positive integer greater than 2 and the number of series-connected resistors in resistor string is at least N−1. The gamma selection unit 120 may include M multiplexers (first through M(th)) gamma selectors 1st GS through M(th) GS. Here, M is a positive integer smaller than N. Each of the first through M(th) gamma selectors 1st GS through M(th) GS select one of the plurality of voltages outputted from the gamma distribution unit 110 as the first through M(th) gamma voltages GV_1 through GV_M in response to first through M(th) gamma selection signals GSS, and outputs the first through M(th) gamma voltages GV_1 through GV_M to the gamma buffer unit 140. For example, in a case where M is 11 and N is 256, the gamma voltage controller 100 outputs 256 gradation voltages V<0> through V<255> (generated by performing voltage divisions between a first gradation voltage GRV1 (i.e., V<0>) and a 256th gradation voltage GRV256 (i.e., V<255>)) and the gamma selection unit 120 includes first through eleventh gamma selectors 1st GS through 11th GS that select first through eleventh gamma voltages GV_1 through GV_11 among a plurality N of voltages, in response to first through eleventh gamma selection signals GSS. The first through eleventh gamma voltages GV_1 through GV_11 are output to the gamma buffer unit 140. The number M of gamma selectors GS may be changed according to the number N of gradation voltages.

The gamma buffer unit 140 receives the first through M(th) gamma voltages GV_1 through GV_M outputted from the M gamma selectors 1st GS through M(th) GS, and buffers each of the M first through M(th) gamma voltages GV_1 through GV_M to output M buffered first through M(th) gamma voltages AGV_1 through AGV_M. The gamma buffer unit 140 may include first through n(th) gamma non-adjustment buffers 1st NCB through n(th) NCB plus first through m(th) inflection point adjustment buffers 1st CB through m(th) CB. Here, n is a positive integer smaller than M, and m is a positive integer equal to M−n. Thus, N+m=M In the gamma buffer unit 140, a first group (i.e., n gamma voltages) of the first through M(th) gamma voltages GV_1 through GV_M is buffered by the first through n(th) gamma non-adjustment buffers 1st NCB through n(th) NCB. In addition, a second group (i.e., m gamma voltages) of the first through M(th) gamma voltages GV_1 through GV_M are buffered by the first through m(th) inflection point adjustment buffers 1st CB through m(th) CB. The first through m(th) inflection point adjustment buffers 1st CB through m(th) CB buffer the first group (i.e., m gamma voltages) to output m buffered gamma voltages to the gradation distribution unit 130, and finely adjust inflection points of a gamma curve by adjusting contact points where the first through m(th)th inflection point adjustment buffers 1st CB through m(th) CB are coupled to the gradation distribution unit 130. The first through n(th) gamma non-adjustment buffers 1st NCB through n(th) NCB buffer the second group (i.e., n gamma voltages) to output n buffered gamma voltages to the gradation distribution unit 130. Contact points where the first through n(th) gamma non-adjustment buffers 1st NCB through n(th) NCB are coupled to the gradation distribution unit 130 may be fixed. The total number of buffers in the gamma buffer unit 140 may be changed according to the number the gradation voltages. The numbers of inflection point adjustment buffers and gamma non-adjustment buffers may be variously changed by the circuit designer. Also, positions of inflection point adjustment buffers and gamma non-adjustment buffers may be variously changed by the circuit designer.

The gradation distribution unit 130 generates second through N−1(th) gradation voltages V<1> through V<N−2> by performing voltage divisions among the buffered first through M(th) gamma voltages AGV_1 through AGV_M, and outputs the second through N−1 (th) gradation voltages V<1> through V<N−2>.

For example, assuming a, b, c, d, and e are positive integers greater than 1, the gradation distribution unit 130 may output the buffered a(th) gamma voltage as the c(th) gradation voltage, the buffered a+1(th) gamma voltage as the c+d(th) gradation voltage, and the buffered a+2(th) gamma voltage as the c+d+e(th) gradation voltage. The values of d and e may vary in various embodiments of the invention. In addition, the gradation distribution unit 130 generates the c+1(th) through c+d−1(th) gradation voltages by performing voltage divisions between the c(th) gradation voltage and the c+d(th) gradation voltage, and generates the c+d+1(th) through c+d+e−1(th) gradation voltages by performing voltage divisions between the c+d(th) gradation voltage and the c+d+e(th) gradation voltage.

The $$\frac{(M+1)}{2}(th)$$

gamma voltage is only used as X-axis symmetry reference voltage but is not used as any gradation voltage, where M is an odd number. Therefore, the gamma voltage controller 100 may support exact X-axis symmetry gamma inversion. To prevent the deterioration of a liquid crystal in the driving of the LCD, an inversion driving method is used during which the display data voltage V_data is applied so that an alignment direction of the liquid crystal changes each predetermined period. The inversion driving method can be classified as one of a frame inversion type, a line inversion type, a column inversion type, and a dot inversion type, depending on the set up of a pixel group that is being simultaneously inverted. Furthermore, the inversion driving method can be classified as a Y-axial symmetric type and an X-axis symmetric type, depending on whether the display data DATA or the gradation voltages V<0> to V<255> are being inverted. A method and apparatus for generating gradation voltages for x-axis symmetric gamma inversion is disclosed in commonly assigned U.S. Patent Application No. 20090096731, which is incorporated by reference herein in its entirety.

The gamma selection register 150 may include level shifters for outputting first through M(th) gamma selection signals GSS to the first through M(th) gamma selectors GV_1 through GV_M. The first through M(th) gamma selection signals GSS respectively control the first through M(th) gamma selectors 1st GS through M(th) GS in the gamma selection unit 120. The inflection point adjustment register (INFPAR) 160 may include level shifters for outputting the first through m(th) inflection point adjustment signals GCS to the first through m(th) inflection point adjustment buffers 1st CB through m(th) CB. The first through m(th) inflection point adjustment signals GCS respectively control the first through m(th) inflection point adjustment buffers 1st CB through m(th) CB in the gamma buffer unit 140. Thus, the gamma selection register 150 controls the gamma curve by controlling the first through M(th) gamma selectors 1st GS through M(th) GS in the gamma selection unit 120, and the inflection point adjustment register (INFPAR) 160 finely adjusts inflection points of the gamma curve by controlling the first through m(th) inflection point adjustment buffers 1st CB through m(th) CB. As such, the gamma curve may be defined by controlling the first through M(th) gamma selectors, and inflection points of the gamma curve may be finely adjusted by adjusting contact points where the first through m(th) inflection point adjustment buffers 1st CB through m(th) CB are coupled to the gradation distribution unit 130. As the result, the gamma voltage controller 100 may output wide-range voltages for various display panels.

Figure 2A:
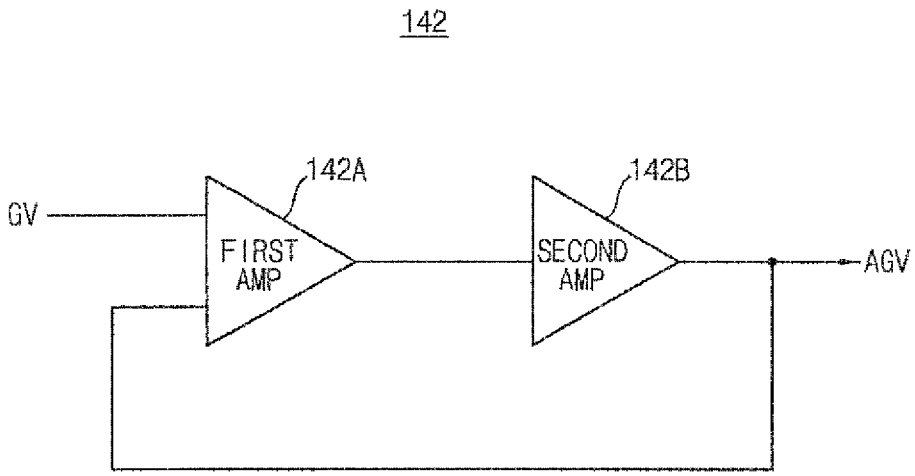
FIG. 2A is a block diagram of a gamma non-adjustment buffer (NCB) 142 in the gamma buffer unit 140 in the gamma voltage controller 100 of FIG. 1.

FIG. 2A is a block diagram of a gamma non-adjustment buffer (NCB) in the gamma buffer unit 140 in the gamma voltage controller 100 of FIG. 1.

Referring to FIG. 2A, the gamma non-adjustment buffer (NCB) 142 may include a first amplifier 142A and a second amplifier 142B.

The gamma non-adjustment buffer (NCB) 142 is a buffer does not adjust inflection points of the gamma curve because each contact point, where the gamma non-adjustment buffer 142 is coupled to the gradation distribution unit 130, is fixed. The first amplifier 142A amplifies a difference between the gamma voltage GV outputted from the gamma selection unit 120 and the output voltage AGV fed back from the second amplifier 142B, and outputs an amplified difference voltage to the second amplifier 142B. The second amplifier 142B amplifies the amplified difference voltage outputted from the first amplifier 142A, and outputs the buffered gamma voltage AGV to the gradation distribution unit 130.

Figure 2B:
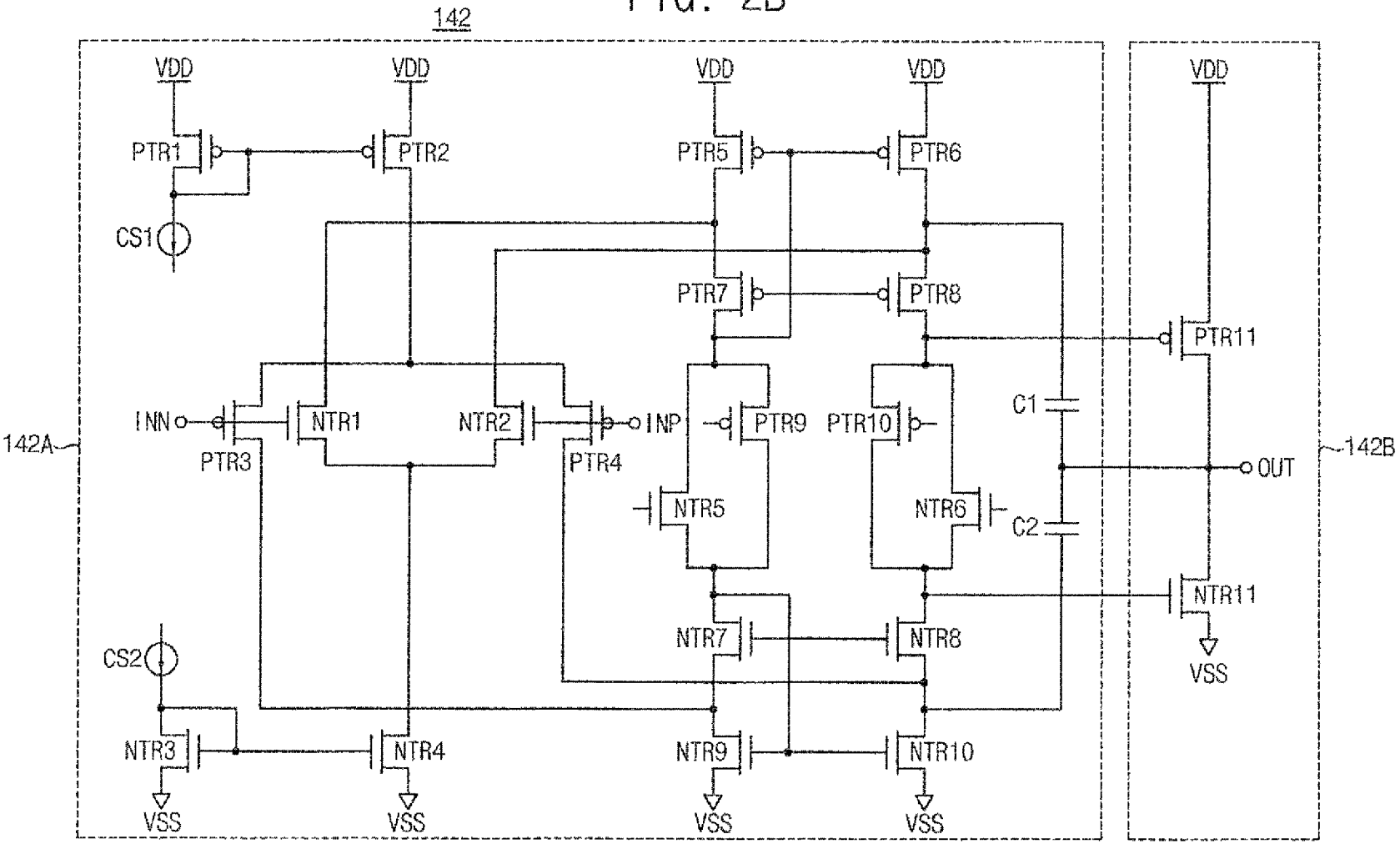
FIG. 2B is a circuit diagram of the gamma non-adjustment buffer 142 of FIG. 2A.

FIG. 2B is a circuit diagram illustrating a gamma non-adjustment buffer of FIG. 2A.

Referring to FIG. 2B, the gamma non-adjustment buffer 142 includes a first amplifier 142A and a second amplifier 142B. The first amplifier 142A includes first through eighth P-type metal oxide semiconductor (PMOS) transistors PTR1 through PTR8, first through tenth N-type metal oxide semiconductor (NMOS) transistors NTR1 through NTR10, first through second current source CS1 through CS2, and first and second capacitors C1 through C2. The second amplifier 142B includes a PMOS transistor PTR11 and an NMOS transistor NTR11. As described above, the first amplifier 142A receives the gamma voltage GV outputted from the gamma selection unit 120 and the output voltage AGV fed back from the second amplifier 142B through input terminals INN and INP, respectively. The first amplifier 142A amplifies the difference between the gamma voltage GV and the output voltage AGV, and outputs the amplified difference voltage to the second amplifier 142B. The second amplifier 142B amplifies the amplified difference voltage outputted from the first amplifier 142A, and outputs the buffered gamma voltage AGV to the gradation distribution unit 130 through an output terminal OUT of the gamma non-adjustment buffer 142.

Figure 3A:
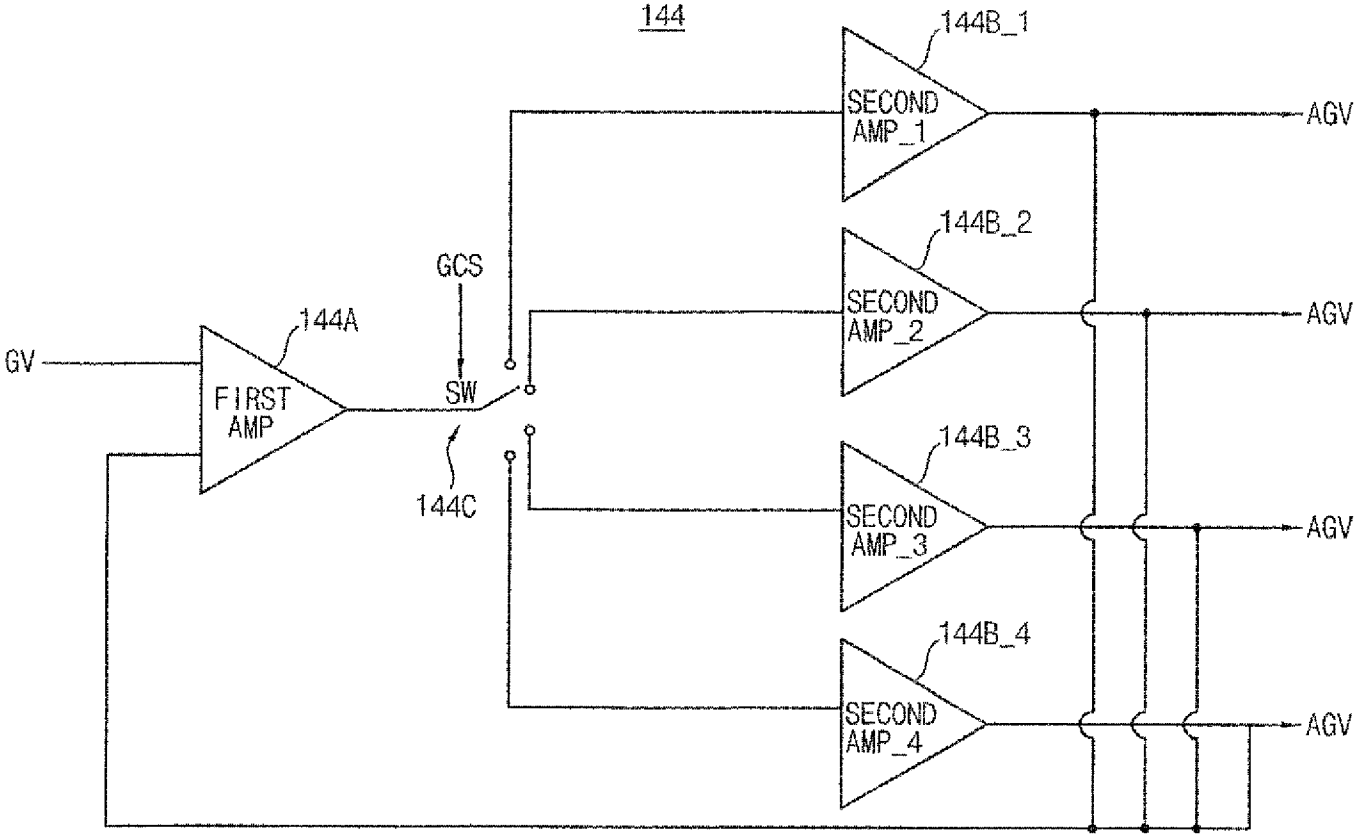
FIG. 3A is a block diagram of a inflection point adjustment buffer 144 of the gamma buffer unit 140 in the gamma voltage controller 100 of FIG. 1.

FIG. 3A is a block diagram of a inflection point adjustment buffer 144 of the gamma buffer unit 140 in the gamma voltage controller 100 of FIG. 1.

Referring to FIG. 3A, the inflection point adjustment buffer 144 includes a first amplifier 144A, second amplifiers 144B_1 through 144B_4 and an inflection point adjustment switch unit 144C. The inflection point adjustment switch unit 144C may be implemented as a set of switching transistors and have a small size (e.g., 1 μm or 2 μm).

The inflection point adjustment buffer 144 is a buffer that adjusts inflection points of the gamma curve because a contact point where the inflection point adjustment buffer 144 is coupled to the gradation distribution unit 130 can be selected using the inflection point adjustment switch unit 144C. The inflection point adjustment switch unit 144C couples the first amplifier 144A to a selected one of the second amplifiers 144B_1 through 144B_4 the selection being based one of the inflection point adjustment signals GCS. The first amplifier 144A amplifies a difference between the gamma voltage GV outputted from the gamma selection unit 120 and the output voltage AGV fed back from the selected one of the second amplifiers 144B_1 through 144B_4, and outputs an amplified difference voltage to the selected one of the second amplifiers 144B_1 through 144B_4. The selected one of the second amplifiers 144B_1 through 144B_4 amplifies the amplified difference voltage outputted from the first amplifier 144A, and outputs the buffered gamma voltage AGV to the gradation distribution unit 130. Thus, inflection points of the gamma curve may be finely adjusted by selecting one of the second amplifiers 144B_1 through 144B_4 based on the inflection point adjustment signal GCS because the second amplifiers 144B_1 through 144B_4 are respectively coupled to different points on the gradation distribution unit 130.

Figure 3B:
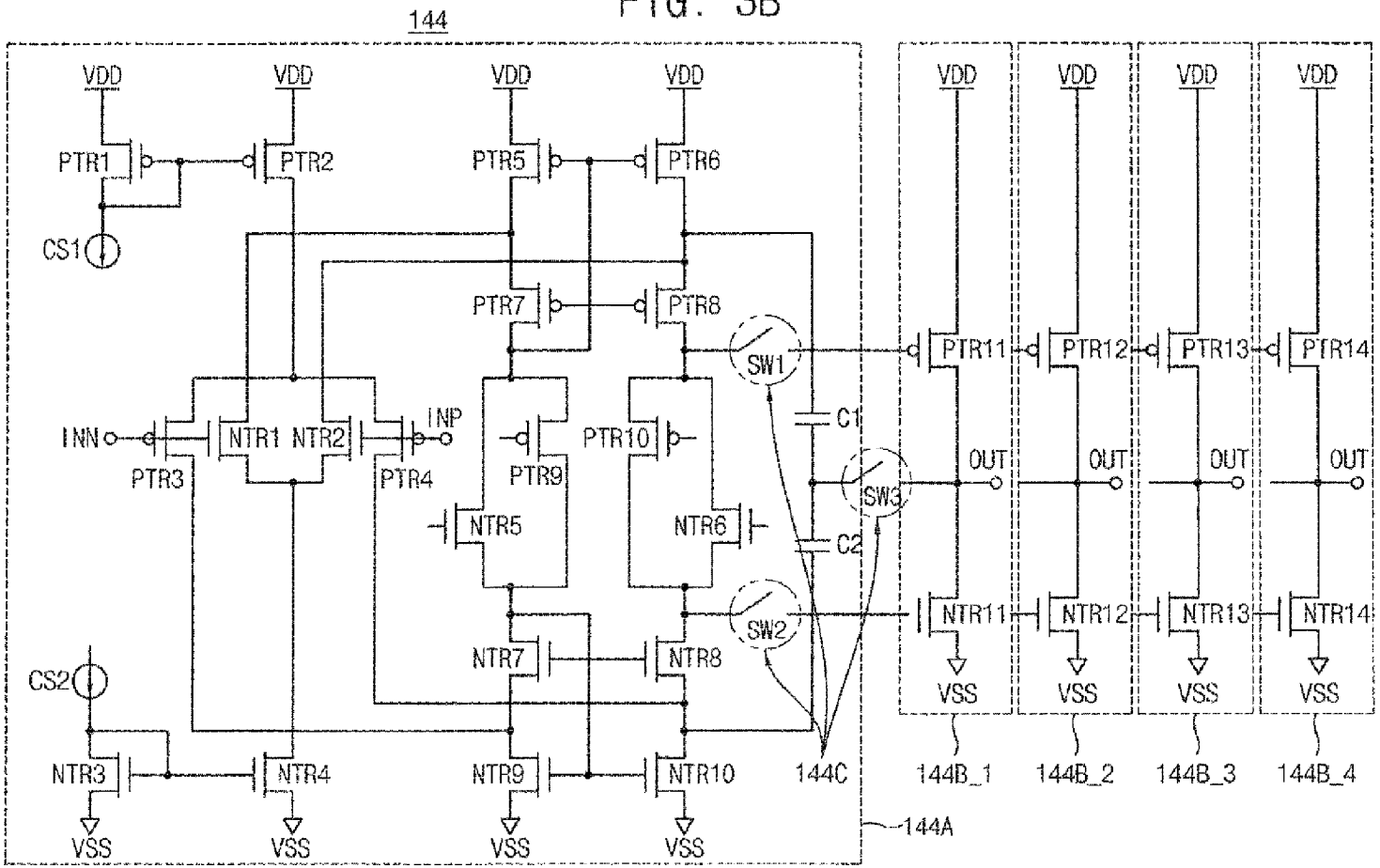
FIG. 3B is a circuit diagram of the inflection point adjustment buffer 144 of FIG. 3A.

FIG. 3B is a circuit diagram illustrating the inflection point adjustment buffer 144 (CB) of FIG. 3A.

Referring to FIG. 3B, the inflection point adjustment buffer 144 includes a first amplifier 144A, second amplifiers 144B_1 through 144B_4, and an inflection point adjustment switch unit 144C. The first amplifier 144A may include first through eighth PMOS transistors PTR1 through PTR8, first through tenth NMOS transistors NTR1 through NTR10, first through second current sources CS1 through CS2, and first and second capacitors C1 through C2. Each of the second amplifiers 144B_1 through 144B_4 may includes a PMOS transistor and an NMOS transistor. Amplifier 144B_1 includes eleventh PMOS transistor PTR11, and eleventh NMOS transistor NTR11. Amplifier 144B_2 includes twelfth PMOS transistor PTR12, and NMOS transistor NTR12. Amplifier 144B_3 includes thirteenth PMOS transistor PTR13, and thirteenth NMOS transistor NTR13. Amplifier 144B_4 includes fourteenth PMOS transistor PTR14, and fourteenth NMOS transistor NTR14. The inflection point adjustment switch unit 144C may include a first multi-throw switch SW1, a second multi-throw switch SW2, and a third multi-throw switch SW3. The first switch SW1 is coupled to one terminal of the eighth PMOS transistor PTR8 of first amplifier 144A, and performs switching operations to couple the one terminal of the eighth PMOS transistor PTR8 to a selected one gate terminal among the four gate terminals of the eleventh through fourteenth PMOS transistors PTR11 through PTR14. The second switch SW2 is coupled to one terminal of the eighth NMOS transistor NTR8 of first amplifier 144A, and performs switching operations to couple the one terminal of the eighth NMOS transistor NTR8 to a selected one gate terminal among the four gate terminals of the eleventh through fourteenth NMOS transistors NTR11 through NTR14. The third switch SW3 is coupled to a node between the first capacitor C1 and the second capacitor C2 of first amplifier 144A, and performs switching operations to couple the node between the first capacitor C1 and the second capacitor C2 to a selected one output terminal among output terminals OUT of the second amplifiers 144B_1 through 144B_4.

As described above, in the inflection point adjustment buffer 144, the first amplifier 144A receives the gamma voltage GV outputted from the gamma selection unit 120 and the output voltage AGV fed back from the selected one of the second amplifiers 144B_1 through 144B_4 through the input terminals INN and INP, amplifies the difference between the gamma voltage GV and the output voltage AGV, and outputs the amplified difference voltage to the selected one of the second amplifiers 144B_1 through 144B_4. The selected one of the second amplifiers 144B_1 through 144B_4 that is coupled to the first amplifier 144A amplifies the amplified difference voltage outputted from the first amplifier 144A, and outputs the buffered gamma voltage AGV to the gradation distribution unit 130 through its output terminal OUT.

Although the inflection point adjustment buffer 144 of FIG. 3B additionally includes the inflection point adjustment switch unit 144C (which is not included in the gamma non-adjustment buffer 142 of FIG. 2A), the zero value derived by small signal analysis of the inflection point adjustment buffer 144 is substantially the same as the zero value derived by small signal analysis of the gamma non-adjustment buffer 142. Thus, the inflection point adjustment switch unit 144C in the inflection point adjustment buffer 144 does not affect DC gain and phase margin so that AC characteristics of the gamma voltage controller 100 are not substantially different compared with AC characteristics of a gamma voltage controller having no inflection point adjustment buffer 144. The inflection point adjustment switch unit 144C in the inflection point adjustment buffer 144 described in FIGS. 3A and 3B is just an exemplary implementation. The switch 144C in the inflection point adjustment buffer 144 may be variously implemented by the circuit designer.

Figure 4:
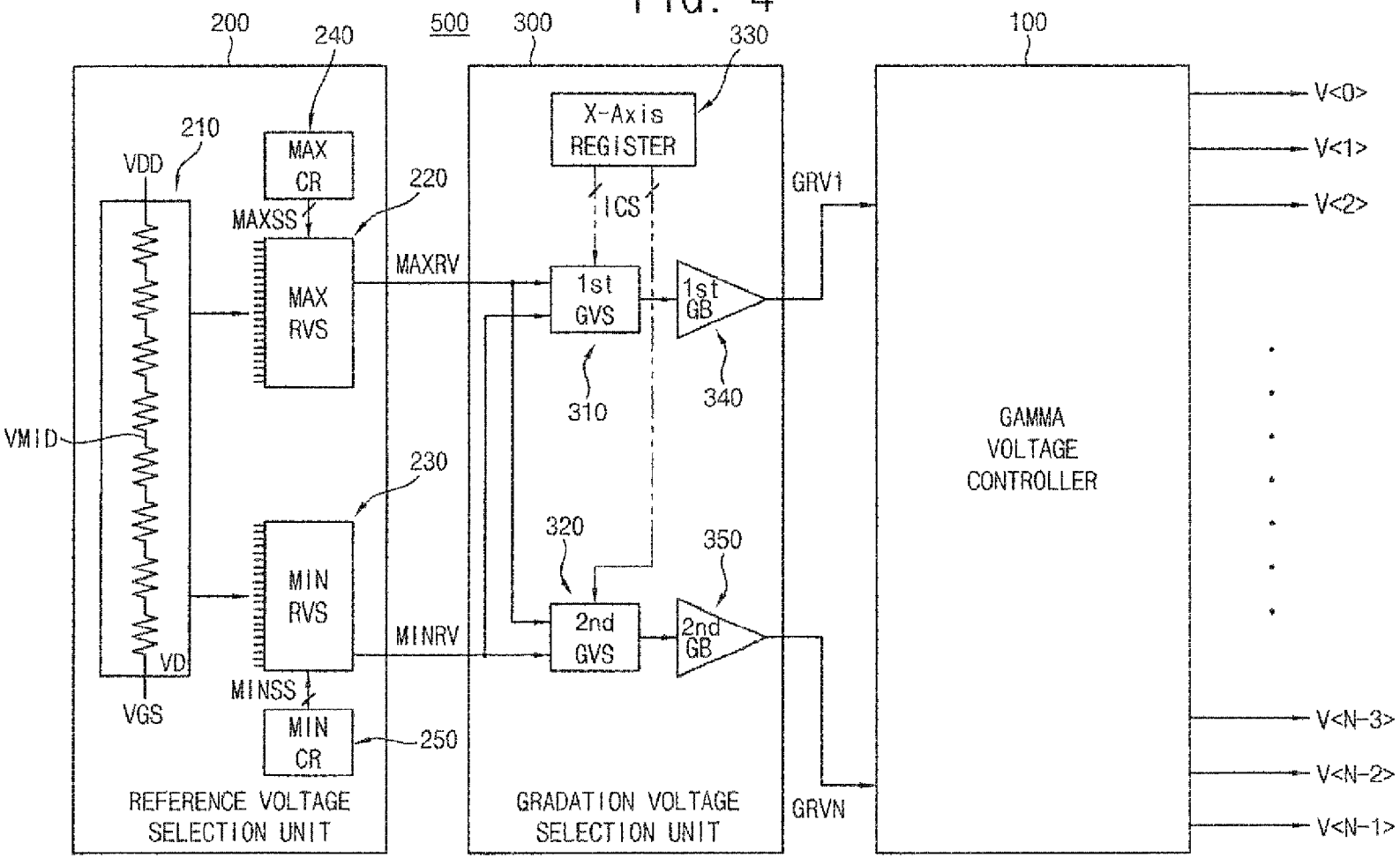
FIG. 4 is a block diagram of a gradation voltage generator 500 including the gamma voltage controller 100 of FIG. 1.

FIG. 4 is a block diagram of a gradation voltage generator 500 according to another exemplary embodiment of the invention.

Referring to FIG. 4, the gradation voltage generator 500 includes the gamma voltage controller 100 of FIG. 1, a reference voltage selection unit 200, and a gradation voltage selection unit 300.

The reference voltage selection unit 200 selects a maximum reference voltage MAXRV and a minimum reference voltage MINRV among a plurality of voltages generated by performing voltage divisions between a first power supply voltage VDD and a second power supply voltage VGS, and outputs the selected maximum reference voltage MAXRV and the selected minimum reference voltage MINRV to the gradation selection unit 300. The reference voltage selection unit 200 includes a power supply voltage distributor 210, a maximum reference voltage selector 220, a minimum reference voltage selector 230, a maximum control register 240, and a minimum control register 250.

The power voltage distributor 210 generates the plurality of voltages by performing voltage divisions between the first power voltage VDD and the second power voltage VGS. The maximum reference voltage selector 220 selects the maximum reference voltage MAXRV from among divided voltages between the first power voltage VDD through a half power voltage VMID in response to a maximum selection signal MAXSS outputted from the maximum control register 240. The minimum reference voltage selector 230 selects the minimum reference voltage MINRV from among the divided voltages between half power voltage VMID through the second power voltage VGS in response to a minimum selection signal MINSS outputted from the minimum control register 250. The maximum control register 240 outputs the maximum selection signal MAXSS to the maximum reference voltage selector 220 through level shifters. The maximum selection signal MAXSS controls the maximum reference voltage selector 220. The minimum control register 250 outputs the minimum selection signal MINSS to the minimum reference voltage selector 230 through level shifters. The minimum selection signal MINSS controls the minimum reference voltage selector 230.

The gradation voltage selection unit 300 alternately applies the maximum reference voltage MAXRV as a first gradation voltage GRV1 (i.e., V<0>) and the minimum reference voltage MINRV as a N(th) gradation voltage GRVN (i.e., V<N−1>), and the minimum reference voltage MINRV as the first gradation voltage GRV1 (i.e., V<0>) and the maximum reference voltage MAXRV as the N(th) gradation voltage GRVN (i.e., V<N−1>). Here, N is a positive integer greater than 2. The gradation voltage selection unit 300 includes a first gradation voltage selector 310, a second gradation voltage selector 320, a X-axis symmetry register 330, a first gradation buffer 340, and a second gradation buffer 350.

The inversion control signal ICS indicates the polarity of a display panel in a display device that uses the gradation voltages form the gradation voltage generator. The first gradation voltage selector 310 is a multiplexer configured to alternately select the maximum reference voltage MAXRV or the minimum reference voltage MINRV as the first gradation voltage GRV1 (i.e., V<0>) based on the inversion control signal ICS, and outputs the first gradation voltage GRV1 (i.e., V<0>). The second gradation voltage selector 320 is a multiplexer configured to alternately select the minimum reference voltage MINRV or the maximum reference voltage MAXRV as the N(th) gradation voltage GRVN (i.e., V<N−1>) based on the inversion control signal ICS, and outputs the N(th) gradation voltage GRVN (i.e., V<N−1>). The X-axis symmetry register 330 outputs the inversion control signal ICS to the first and second gradation voltage selectors 310 and 320 through level shifters. The inversion control signal ICS controls the first and second gradation voltage selectors 310 and 320. The first gradation buffer 340 buffers the first gradation voltage GRV1 (i.e., V<0>) outputted from the first gradation voltage selector 310, and outputs the first gradation voltage GRV1 (i.e., V<0>) to the gamma voltage controller 100. The second gradation buffer 350 buffers the N(th) gradation voltage GRVN (i.e., V<N−1>) outputted from the second gradation voltage selector 320, and outputs the N(th) gradation voltage GRVN (i.e., V<N−1>) to the gamma voltage controller 100.

The gamma voltage controller 100 receives the first and N(th) gradation voltages GRV1 and GRVN (i.e., V<0> and V<N−1>), generates second through N−1 (th) gradation voltages V<1> through V<N−2> based on the first and N(th) gradation voltages GRV1 and GRVN (i.e., V<0> and V<N−1>), and outputs the first through N(th) gradation voltages V<0> through V<N−1>. As described above, the gamma voltage controller 100 may determine a gamma curve and may finely adjust inflection points of the gamma curve. For these operations, the gamma voltage controller 100 may include a gamma distribution unit, a gamma selection unit, a gamma buffer unit, and a gradation distribution unit, as described above with reference to FIG. 1. As a result, the gradation voltage generator 500 having the gamma voltage controller 100 may output wide-range voltages for various display panels by determining the gamma curve and finely adjusting inflection points of the gamma curve.

The gradation voltage generator 500 may operate during two different operation periods. During a first operation period, a logic level of the inversion control signal ICS is a first level (i.e., HIGH level or LOW level). During a second operation period, the logic level of the inversion control signal ICS is a second level (i.e., LOW level or HIGH level). Thus, the first operation period is complementary to the second operation period. For example, during the first operation period, the first gradation voltage selector 310 selects the maximum reference voltage MAXRV as the first gradation voltage GRV1 (i.e., V<0>), and the second gradation voltage selector 320 selects the minimum reference voltage MINRV as the N(th) gradation voltage GRVN (i.e. V<N−1>). On the other hand, during the second operation period, the first gradation voltage selector 310 selects the minimum reference voltage MINRV as the first gradation voltage GRV1 (i.e., V<0>), and the second gradation voltage selector 320 selects the maximum reference voltage MAXRV as the N(th) gradation voltage GRVN (i.e., V<N−1>).

Therefore, during the first operation period, the gradation voltage generator 500 outputs the first through N(th) gradation voltages V<0> through V<N−1> by generating the second through N−1(th) gradation voltages V<1> through V<N−2> using the maximum reference voltage MAXRV as the first gradation voltage GRV1 (i.e., V<0>) and the minimum reference voltage MINRV as the N(th) gradation voltage GRVN (i.e., V<N−1>). On the other hand, during the second operation period the gradation voltage generator 500 outputs the first through N(th) gradation voltages V<0> through V<N−1> by generating the second through N−1 (th) gradation voltages V<1> through V<N−2> using the minimum reference voltage MINRV as the first gradation voltage GRV1 (i.e., V<0>) and the maximum reference voltage MAXRV as the N(th) gradation voltage GRVN (i.e., V<N−1>). As the result, the gradation voltage generator 500 supports exact X-axis symmetry gamma inversion because the gradation voltage generator 500 periodically swaps the first gradation voltage GRV1 (i.e., V<0>) and the N(th) gradation voltage GRVN (i.e., V<N−1>) to each other. Thus, the gradation voltage generator 500 periodically performs complementary operations during the first operation period and the second operation period. Therefore, the gradation voltage generator 500 supports exact X-axis symmetry gamma inversion and prevents an LCD panel from being degraded.

Figure 5:
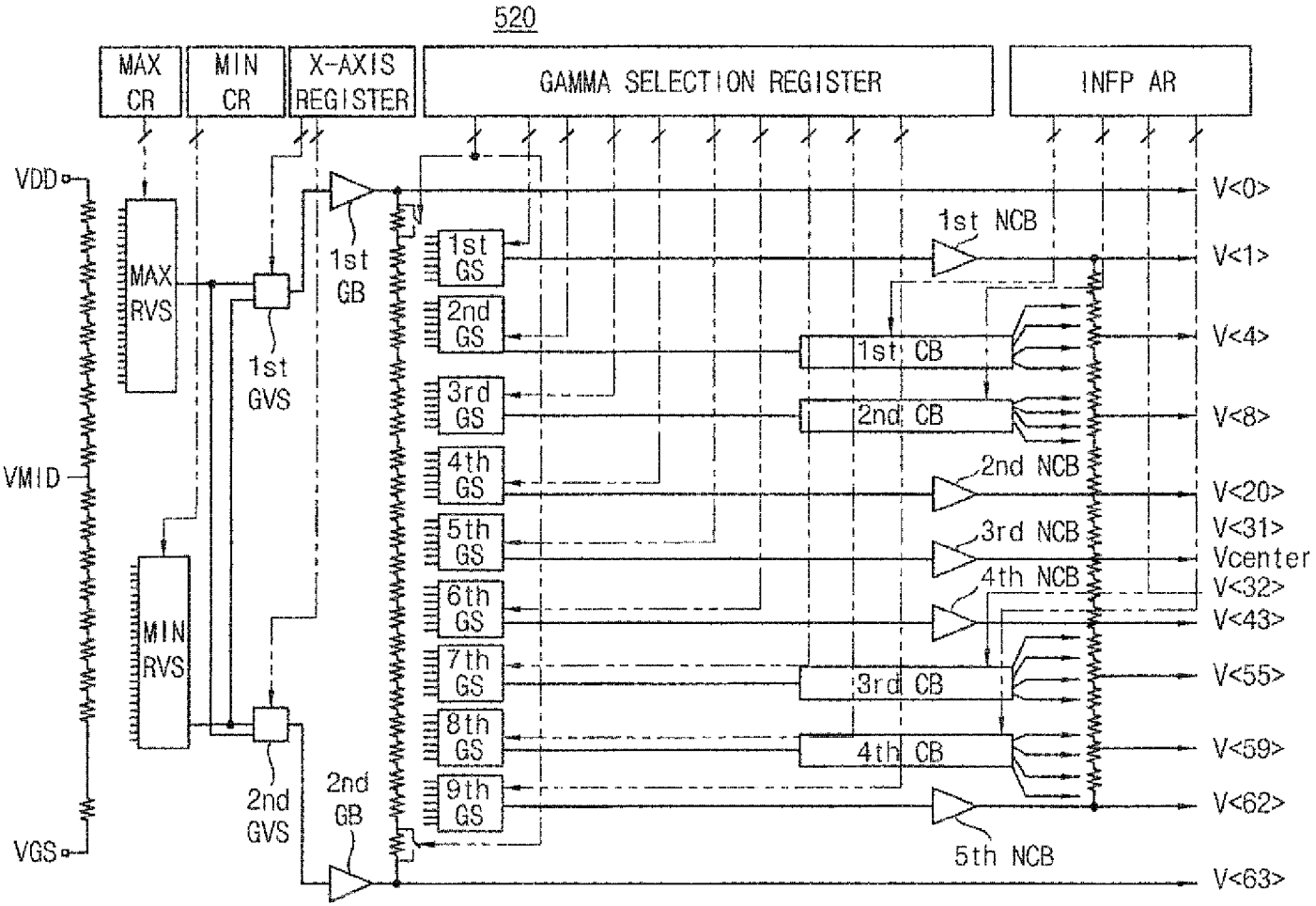
FIG. 5 is a block diagram of an exemplary implementation 520 of the gradation voltage generator 500 of FIG. 4 outputting 64 gradation voltages.

FIG. 5 is a block diagram of an exemplary implementation 520 of the gradation voltage generator 500 of FIG. 4 outputting 64 gradation voltages.

Referring to FIG. 5, the gradation voltage generator 520 outputs 64 gradation voltages. A gamma selection unit 120 includes first through ninth gamma selectors 1st GS through 9th GS. A gamma buffer unit 140 includes first through fifth gamma non-adjustment buffers 1st NCB through 5th NCB and first through fourth inflection point adjustment buffers 1st CB through 4th CB. Thus, the gradation voltage generator 520 outputs first through 64th gradation voltages V<0> through V<63> by generating the second through 63rd gradation voltages V<1> through V<62> using the first gradation voltage V<0> and the 64th gradation voltage V<63>. The fifth gamma voltage outputted from the fifth gamma selector 5th GS to a gradation distribution unit through third the gamma non-adjustment buffer 3rd NCB is only used as a X-axis symmetry reference voltage Vcenter not as a gradation voltage. The gradation voltage generator 520 determines the gamma curve by controlling the first through ninth gamma selectors 1st GS through 9th GS, and may finely adjust inflection points of the gamma curve by adjusting contact points where the first through fourth inflection point adjustment buffers 1st CB through 4th CB are coupled to the gradation distribution unit 130 (see FIG. 1). As the result, the gradation voltage generator 520 may provide proper gamma curves for various display panels having unique gamma characteristics, and may support exact X-axis symmetry gamma inversion. The structure of the gradation voltage generator 520 may be variously changed by the circuit designer.

Figure 6:
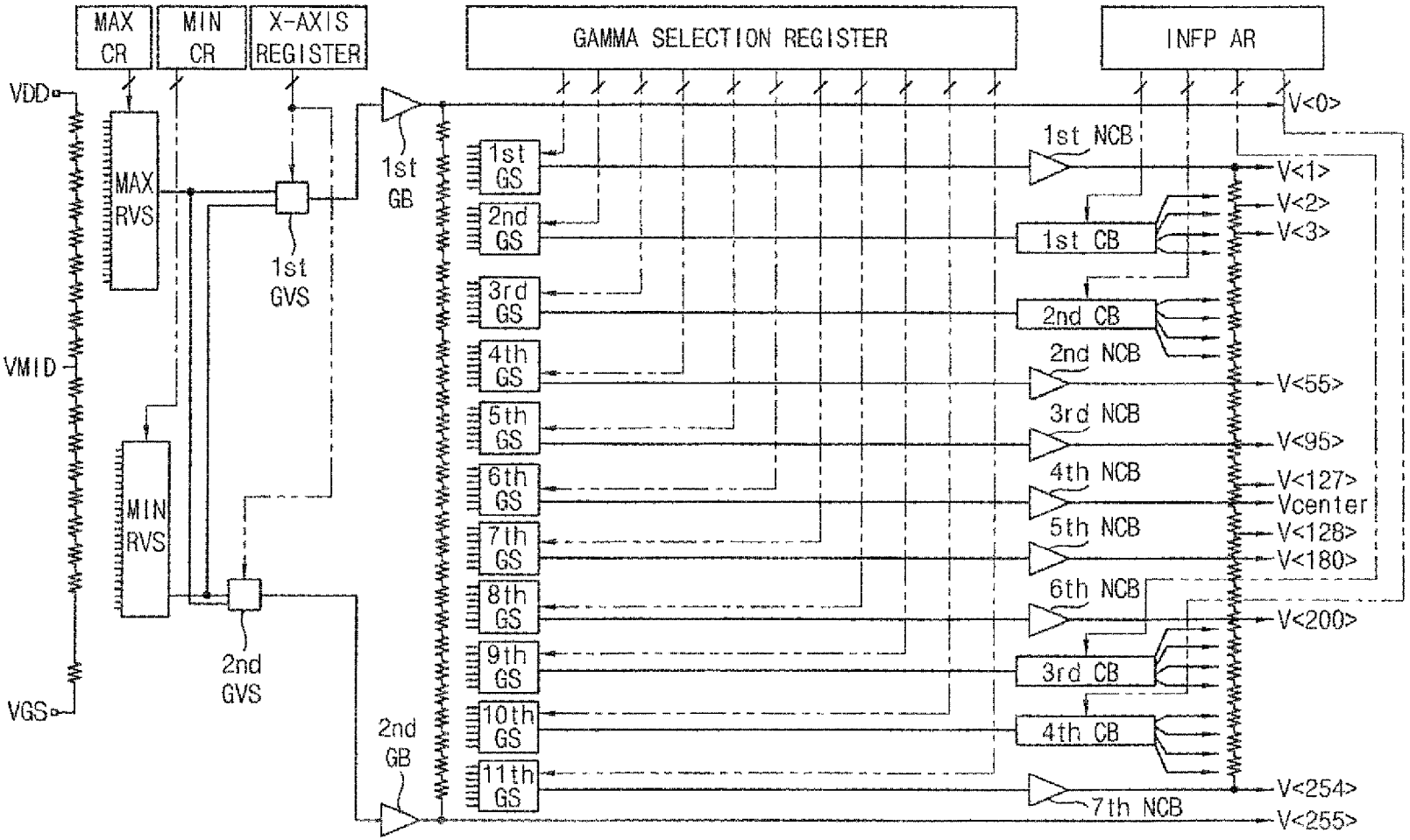
FIG. 6 is a block diagram of an exemplary implementation 540 of the gradation voltage generator 500 of FIG. 4 outputting 256 gradation voltages.

FIG. 6 is a block diagram of an exemplary implementation 540 of the gradation voltage generator 500 of FIG. 4 outputting 256 gradation voltages.

Referring to FIG. 6, the gradation voltage generator 540 outputs 256 gradation voltages. A gamma selection unit 120 includes first through eleventh gamma selectors 1st GS through 11th GS. A gamma buffer unit 140 includes first through seventh gamma non-adjustment buffers 1st NCB through 7th NCB and first through fourth inflection point adjustment buffer 1st CB through 4th CB. Thus, the gradation voltage generator 540 outputs first through 256th gradation voltages V<0> through V<255> by generating the second through 255th gradation voltages V<1> through V<254> using the first gradation voltage V<0> and the 256th gradation voltage V<255>. The sixth gamma voltage outputted from sixth gamma selector 6th GS to the gradation distribution unit through fourth gamma non-adjustment buffer 4th NCB is only used as a X-axis symmetry reference voltage Vcenter not as a gradation voltage. Therefore, the gradation voltage generator 540 determines the gamma curve by controlling the first through eleventh gamma selectors 1st GS through 11th GS, and may finely adjust inflection points of the gamma curve by adjusting contact points where the first through fourth inflection point adjustment buffers 1st CB through 4th CB are coupled to the gradation distribution unit 130 (see FIG. 1). As the result, the gradation voltage generator 540 may provide proper gamma curves for various display panels having unique gamma characteristics, and may support exact X-axis symmetry gamma inversion. The structure of the gradation voltage generator 540 may be variously changed by the circuit designer.

As described above, the exemplary gradation voltage generator 520 shown in FIG. 5 may output 64 gradation voltages V<0> through V<63>, and the exemplary gradation voltage generator 540 of FIG. 6 may output 256 gradation voltages V<0> through V<255>. However, gradation voltage generators according to various embodiments of the present invention may be implemented to output 128 gradation voltages, 512 gradation voltages, 1024 gradation voltages, etc.

Figure 7:
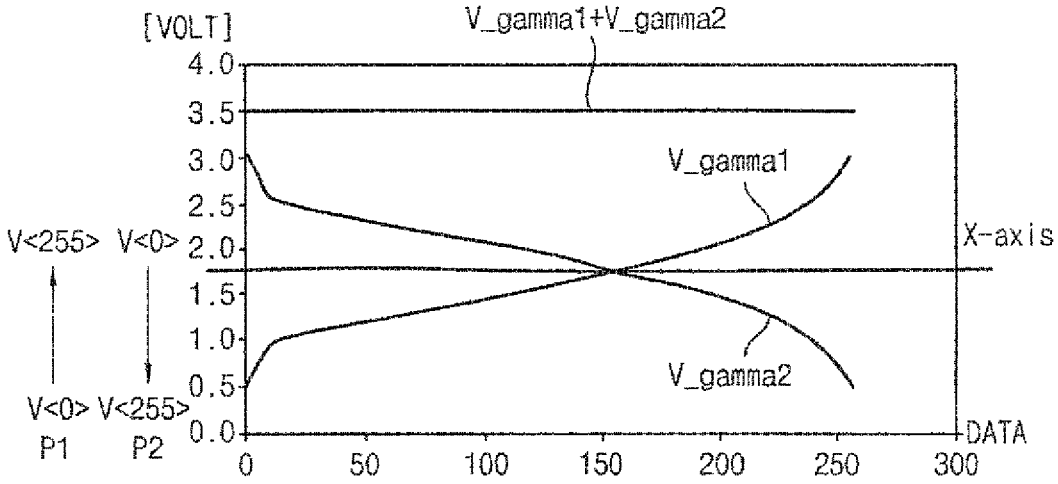
FIG. 7 is a graph of a plurality of gradation voltages outputted from the gradation voltage generator 540 of FIG. 6.

FIG. 7 is a graph illustrating a plurality of gradation voltages outputted from the gradation voltage generator 540 of FIG. 6.

Referring to FIG. 7, the gradation voltage generator 540 may support exact X-axis symmetry gamma inversion by employing a X-axis symmetry method. A first gamma curve V_gamma1 and a second gamma curve V_gamma2 are symmetric with respect to a X-axis. The gradation voltage generator 540 outputs 256 gradation voltages V<0> through V<255> to a data driver according to the first gamma curve V_gamma1 during a first operation period P1, so that data voltages DATA are mapped to the first gamma curve V_gamma1. The gradation voltage generator 540 outputs 256 gradation voltages V<255> through V<0> to the data driver according to the second gamma curve V_gamma2 during a second operation period P2, so that the data voltages DATA are mapped to the second gamma curve V_gamma2. Therefore, the gradation voltage generator 540 may support exact X-axis gamma inversion because the sum of the first gamma curve V_gamma1 and the second gamma curve V_gamma2 is constant.

Figure 8:
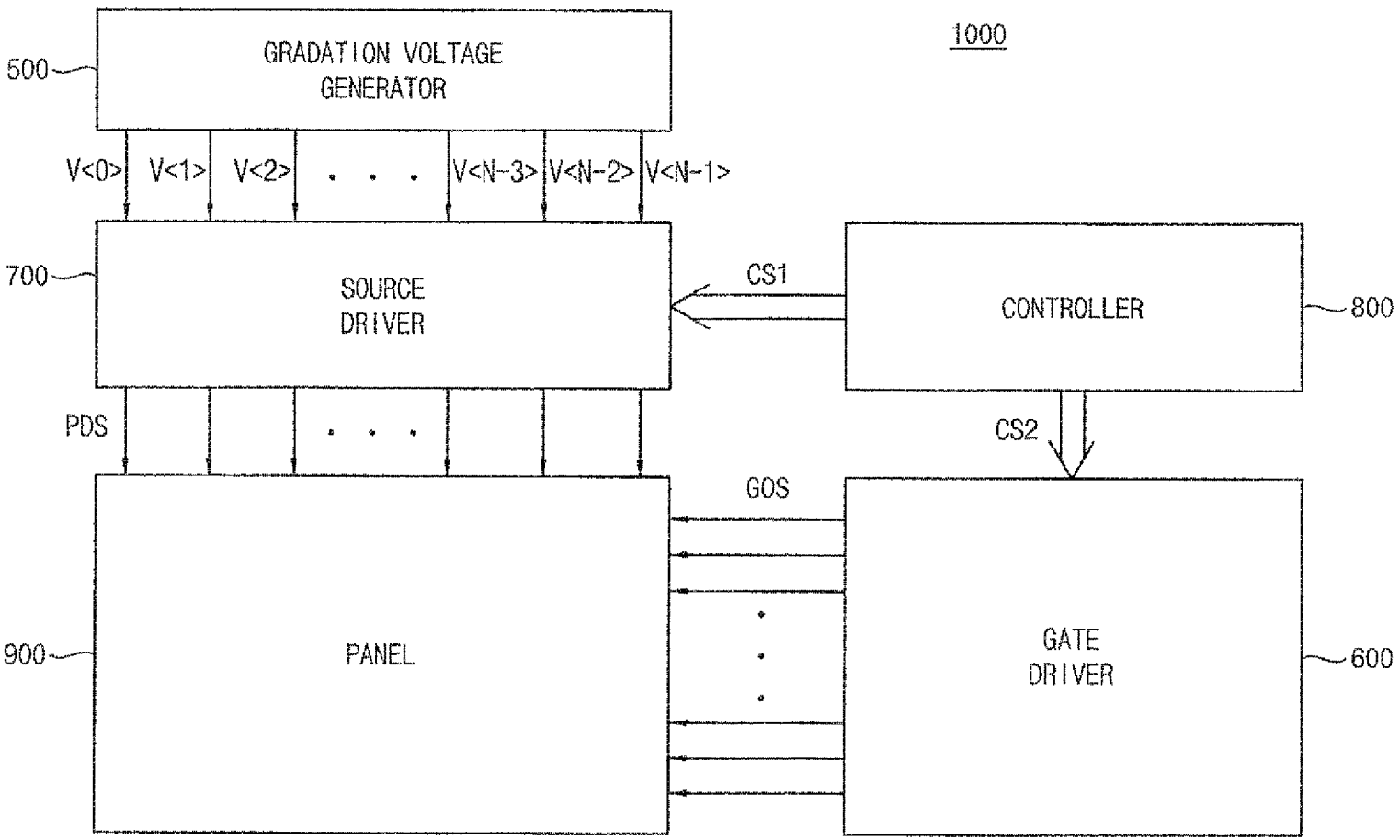
FIG. 8 is a block diagram of liquid crystal display (LCD) including the gradation voltage generator 500 of FIG. 4.

FIG. 8 is a block diagram of a liquid crystal display (LCD) device including the gradation voltage generator 500 of FIG. 4.

Referring to FIG. 8, the display device 1000 may include a gradation voltage generator 500, a gate driver 600, a data driver 700, a controller 800, and a LC display panel 900.

In the display device 1000, the gradation voltage generator 500 of FIG. 4 provides a plurality of gradation voltages V<0> through V<N−1> to the data driver 700. The data driver 700 provides data voltages PDS to data lines of the display panel 900. The gate driver 600 provides gate-on voltages GOS to gate lines of the display panel 900. The controller 800 controls the gate driver 600 and the data driver 700 by providing a data driver control signal CS1 and a gate driver control signal CS2 to the data driver 700 and the gate driver 600, respectively.

The gradation voltage generator 500 selects a maximum reference voltage and a minimum reference voltage among a plurality of power voltages generated by performing voltage divisions between a first power voltage and a second power voltage, defines the maximum reference voltage as a first gradation voltage V<0> or as a N(th) gradation voltage V<N−1> and the minimum reference voltage as the N(th) gradation voltage V<N−1> or as the first gradation voltage V<0>, determines a gamma curve by selecting first through M(th) gamma voltages among a plurality of voltages generated by performing voltage divisions between the first gradation voltage V<0> and the N(th) gradation voltage V<N−1>, finely adjusts inflection points of the gamma curve by adjusting contact points where inflection point adjustment buffers in a gamma buffer unit are coupled to a gradation distribution unit, and generates second through N−1(th) gradation voltages V<1> through V<N−2> based on the gamma curve. As the result, the gradation voltage generator 500 may output the first through N(th) gradation voltages V<0> through V<N−1> to the data driver 700. As such, the display device 1000 may properly display pictures on the LC display panel 900.

As described above, referring to some exemplary embodiments, a gamma voltage controller, a gradation voltage generator having the gamma voltage controller, and a display device having the gradation voltage generator are described in detail. However, the illustrated structures of the gamma voltage controller, the gradation voltage generator, and the display device are just examples, so that various changes, substitutions and alterations may be made without departing from the scope of the invention. In addition, the gamma voltage controller, the gradation voltage generator, and the display device may be applicable to various display panels having unique characteristics because the gamma voltage controller, the gradation voltage generator, and the display device may output wide-range voltages for various display panels by determining a gamma curve and finely adjusting inflection points of the gamma curve. Further, the scope of the present invention may extend to various electronic systems having display devices.

While the exemplary embodiments have been described in detail, it should be understood that various changes, substitutions and alterations may be made herein without departing from the scope of the invention.

What is claimed is:

1. A gamma voltage controller, comprising:

a gamma distribution unit configured to generate a plurality of voltages by performing voltage divisions between a first gradation voltage and a N(th) gradation voltage, N being a positive integer greater than 2;

a gamma selection unit having first through M(th) gamma selectors, the first through M(th) gamma selectors respectively selecting first through M(th) gamma voltages among the plurality of voltages to define a gamma curve, M being a positive integer smaller than N;

a gamma buffer unit configured to adjust inflection points of the gamma curve, and configured to buffer the first through M(th) gamma voltages to output buffered first through M(th) gamma voltages; and a gradation distribution unit configured to generate second through N−1(th) gradation voltages by performing voltage divisions among the buffered first through M(th) gamma voltages;

wherein the gamma buffer unit comprises:

first through n(th) gamma non-adjustment buffers configured to buffer n gamma voltages outputted from the first through M(th) gamma selectors to output n buffered gamma voltages to the gradation distribution unit, n being a positive integer smaller than M; and first through m(th) inflection point adjustment buffers configured to buffer m gamma voltages outputted from the first through M(th) gamma selectors and to output m buffered gamma voltages to selectable voltage division contact points of the gradation distribution unit to adjust inflection points of the gamma curve m being a positive integer equal to M−n;

wherein each of the first through m(th) inflection point adjustment buffers further comprises:

a first amplifier and second amplifiers;

the second amplifiers configured to amplify the difference outputted from the first amplifier, the second amplifiers being respectively coupled to different points on the gradation distribution unit; and an inflection point adjustment switch unit configured to couple the first amplifier to one of the second amplifiers.

2. The gamma voltage controller of claim 1, wherein each of the first through n(th) gamma non-adjustment buffers comprises:

a first amplifier configured to amplify a difference between a gamma voltage outputted from the gamma selection unit and a output voltage fed back from second amplifier; and the second amplifier configured to amplify the difference outputted from the first amplifier.

3. The gamma voltage controller of claim 1, further comprising:

a gamma selection register configured to provide the first through M(th) gamma selectors with first through M(th) gamma selection signals for controlling the first through M(th) gamma selectors.

4. The gamma voltage controller of claim 1, further comprising:

a inflection point adjustment register (INFPAR) configured to provide the first through m(th) inflection point adjustment buffers with first through m(th) inflection point adjustment signals for controlling the first through m(th) inflection point adjustment buffers.

5. The gamma voltage controller of claim 1, wherein a $$\frac{(M+1)}{2}(th)$$

gamma voltage outputted from a $$\frac{(M+1)}{2}(th)$$

gamma selector to the gradation distribution unit through the gamma buffer unit is used as a X-axis symmetry reference voltage, M being an odd integer.

6. A gamma voltage controller, comprising:

a gamma distribution unit configured to generate a plurality of voltages by performing voltage divisions between a first gradation voltage and a N(th) gradation voltage, N being a positive integer greater than 2;

a gamma selection unit having first through M(th) gamma selectors, the first through M(th) gamma selectors respectively selecting first through M(th) gamma voltages among the plurality of voltages to define a gamma curve, M being a positive integer smaller than N;

a gamma buffer unit configured to adjust inflection points of the gamma curve, and configured to buffer the first through M(th) gamma voltages to output buffered first through M(th) gamma voltages; and a gradation distribution unit configured to generate second through N−1(th) gradation voltages by performing voltage divisions among the buffered first through M(th) gamma voltages, wherein the gamma buffer unit comprises:

first through n(th) gamma non-adjustment buffers configured to buffer n gamma voltages outputted from the first through M(th) gamma selectors to output n buffered gamma voltages to the gradation distribution unit, n being a positive integer smaller than M; and first through m(th) inflection point adjustment buffers configured to buffer m gamma voltages outputted from the first through M(th) gamma selectors and to output m buffered gamma voltages to the gradation distribution unit, contact points where the first through m(th) inflection point adjustment buffers are coupled to the gradation distribution unit being adjusted to adjust inflection points of the gamma curve, m being a positive integer equal to M−n, wherein each of the first through m(th) inflection point adjustment buffers comprises:

a first amplifier configured to amplify a difference between a gamma voltage outputted from the gamma selection unit and a output voltage fed back from a selected one among second amplifiers, the second amplifiers configured to amplify the difference outputted from the first amplifier, the second amplifiers being respectively coupled to different points on the gradation distribution unit; and an inflection point adjustment switch unit configured to couple the first amplifier to one of the second amplifiers.

* * * * *